US010349191B2

(12) United States Patent
Minnaar

(10) Patent No.: US 10,349,191 B2
(45) Date of Patent: Jul. 9, 2019

(54) BINAURAL GEARING SYSTEM AND METHOD

(71) Applicant: OTICON A/S, Smørum (DK)

(72) Inventor: Pauli Minnaar, Smørum (DK)

(73) Assignee: Oticon A/S, Smørum (DK)

( * ) Notice: Subject to any disclaimer, the term of this patent is extended or adjusted under 35 U.S.C. 154(b) by 16 days.

(21) Appl. No.: 15/668,344

(22) Filed: Aug. 3, 2017

(65) Prior Publication Data

US 2017/0332182 A1 Nov. 16, 2017

Related U.S. Application Data

(63) Continuation of application No. 14/842,543, filed on Sep. 1, 2015, now Pat. No. 9,749,757.

(30) Foreign Application Priority Data

Sep. 2, 2014 (EP) ..... 14183198

(51) Int. Cl.
*H04R 25/00* (2006.01)

(52) U.S. Cl.
CPC ..... *H04R 25/552* (2013.01); *H04R 25/407* (2013.01); *H04R 25/50* (2013.01); *H04R 25/554* (2013.01); *H04S 2420/01* (2013.01)

(58) Field of Classification Search
CPC .... H04R 25/552; H04R 25/407; H04R 25/50; H04R 25/554; H04S 2420/01
See application file for complete search history.

(56) References Cited

U.S. PATENT DOCUMENTS

2010/0002886 A1 1/2010 Doclo et al.
2011/0116666 A1 5/2011 Dittberner et al.
2012/0201389 A1* 8/2012 Emerit ..... H04S 1/002 381/23
2014/0185813 A1 7/2014 Ozden et al.
2015/0181355 A1 6/2015 Pedersen

FOREIGN PATENT DOCUMENTS

WO WO 2007/128825 A1 11/2007
WO WO 2013/159809 A1 10/2013

* cited by examiner

*Primary Examiner* — Regina N Holder
(74) *Attorney, Agent, or Firm* — Birch, Stewart, Kolasch & Birch, LLP

(57) ABSTRACT

The present disclosure regards a binaural hearing system configured to receive sound signals from the environment having two hearing instruments to be worn on respective sides of the head of a user and to generate a binaural signal using the received sound signals of both hearing instruments.

9 Claims, 6 Drawing Sheets

BINAURAL GEARING SYSTEM AND METHOD

Figure 1:
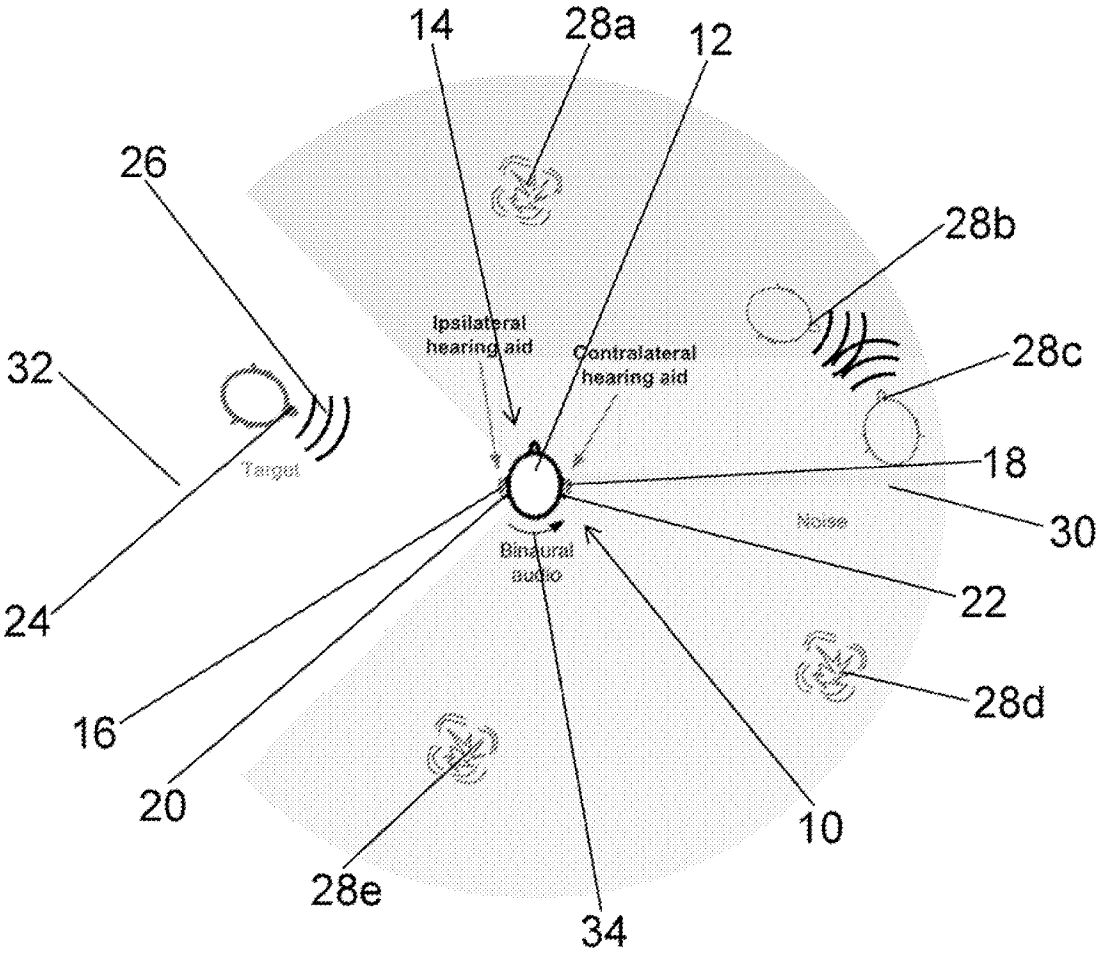

This application is a Continuation of copending application Ser. No. 14/842,543, filed on Sep. 1, 2015, which claims priority under 35 U.S.C. § 119(a) to application Ser. No. 14/183,198.2, filed in Europe on Sep. 2, 2014, all of which are hereby expressly incorporated by reference into the present application.

The disclosure regards a binaural hearing system comprising two hearing instruments each configured to be worn on either side of the head of a user. The disclosure further regards a method for generating binaural electrical signals.

Hearing instruments are used to improve or allow auditory perception, i.e., hearing. Hearing aids as one group of hearing instruments are commonly used today and help hearing impaired people to improve their hearing ability, such as compensate for a user's hearing loss, e.g. by amplification and/or frequency processing of audio. Hearing aids typically comprise a microphone, an output transducer, electric circuitry, and a power source, e.g., a battery. The output transducer can for example be a speaker, also called receiver, a vibrator, an electrode array configured to be implanted at a cochlear, or any other instrument that is able to generate sound signals from electrical signals. The microphone receives a sound signal from the environment and generates an electrical signal from the received sound signal. The electrical signal is processed, e.g., frequency selectively amplified, noise reduced, adjusted to a listening environment, and/or frequency transposed or the like, by the electric circuitry and a processed sound signal is generated by the output transducer which can be provided to the user of the hearing aid. In order to improve the hearing experience of the user a spectral filter bank can be included in the electric circuitry, which, e.g., analyses different frequency bands or processes electrical signals in different frequency bands individually and allows improving the signal-to-noise ratio. Spectral filter banks are typically running online in any hearing aid today.

One way to characterize hearing aids is by the way they are fitted to an ear of the user. Hearing aids include for example ITE (In-The-Ear), RITE (Receiver-In-The-Ear), ITC (In-The-Canal), CIC (Completely-In-the-Canal), and BTE (Behind-The-Ear) hearing aids. The majority of the components of the ITE hearing aids are located in an ear, while ITC and CIC hearing aid components are located in an ear canal. BTE hearing aids typically comprise a Behind-The-Ear unit, which is generally mounted behind or on an ear of the user and which is connected to an air filled tube that has a distal end that can be fitted in an ear canal of the user. Sound generated by a speaker can be transmitted through the air filled tube to an ear drum of the user's ear canal. RITE hearing aids typically comprise a BTE unit arranged behind or on an ear of the user and an ITE unit with a receiver, i.e., speaker, which is arranged in an ear canal of the user. The BTE unit and ITE unit are typically connected via a lead. An electrical signal can be transmitted to the receiver, i.e., speaker, arranged in the ear canal via the lead.

Typically the microphones of the hearing instruments used to receive the sound from the environment are omnidirectional, meaning that they do not differentiate between the directions of the sound. In order to improve the hearing of a user a beamformer can be included in the electric circuitry. The beamformer improves the spatial hearing by suppressing sound from other directions than a direction defined by beamformer parameters, i.e., a hearing direction. In this way the signal-to-noise ratio can be increased, as mainly sound from a sound source, e.g., in front of the user is received. Typically, a beamformer divides the space in two subspaces, one from which sound is received and the rest, where sound is suppressed, which results in spatial hearing.

Hearing instruments can be worn at one ear, i.e., monaurally, or at both ears, i.e., binaurally. Binaural hearing systems comprise two hearing instruments, one for a left ear and one for a right ear of the user. The hearing instruments of the binaural hearing system can exchange information with each other wirelessly and allow spatial hearing by simulating binaural directionality, i.e., both hearing aids can be used together to reduce the sound on one side of the head in order to make it easier to hear what is being said on the other side. The hearing instruments can therefore use the same type of beamforming techniques as are used in hearing aid directionality processing for monaural hearing aids to simulate binaural directionality of humans. These types of beamforming techniques do not work well in practice, though. Beamforming works well at low frequencies, below about 1 kHz, but shows insufficient performance for higher frequencies due to spatial aliasing problems. Another issue is that the output of binaural beamformers is monophonic, i.e., a single channel. When this monophonic output is presented to the user the spatial properties of the sound is normally completely changed and the sound is typically internalised, i.e., the sound sounds as if the sound is heard inside of the head. Yet another problem with using binaural beamformers in hearing aids is that beamformers rely on very good transmission quality. If a very good transmission quality cannot be ensured, as is the case in hearing aids, because of too low bit rates, poor performance results.

US 2010/0002886A1 presents a binaural hearing system comprising ITF means and noise reduction means and a method for operating a binaural hearing system. The ITF means are configured for providing an interaural transfer function (ITF), e.g., by calculating the ITF as a quotient of two head related transfer functions (HRTF) for the same angle, with one HRTF for the left ear and one HRTF for the right ear. The noise reduction means, e.g., two binaural Wiener filters, are configured for performing noise reduction in dependence of said interaural transfer function. The binaural hearing system can comprise a first and a second device with a sending unit in the first device and a receiving unit in the second device. Data can be transmitted from the first to the second device. The data can be compressed by a preprocessor, in particular by perceptual coding, i.e., a compression making use of the fact that certain components of audio signals are not or hardly perceivable by the human ear, which therefore can be omitted. Additionally bandwidth of ITF data transmission can be reduced by transmitting only a portion of full ITF data, as ITF usually will not change very fast, since sound sources usually do not move very fast.

An object of the present disclosure is to provide an improved binaural hearing system and a method for generating a binaural electrical signal. A further object is to provide an alternative to the prior art.

It would be advantageous to achieve a binaural hearing system generating a binaural electrical signal while requiring only a fraction of the full bandwidth of the electrical signal to be transmitted. It would also be desirable to enable a binaural hearing system to preserve spatial cue while improving the signal to noise ratio.

To better address one or more of these concerns, in one aspect of the disclosure a binaural hearing system is presented, which comprises two hearing instruments each configured to be worn by a user on either side of the head. Each of said hearing instruments comprises an input transducer, e.g., a microphone and a signal processing unit. The input transducer is configured for receiving a sound signal from the environment and for generating an electrical signal from the received sound signal. One of the signal processing units of the binaural hearing system comprises a frequency filter unit comprising frequency filters for generating a higher frequency part and a lower frequency part of an electrical signal. The other signal processing unit comprises a frequency filter unit comprising frequency filters for generating a lower frequency part of an electrical signal. One of the hearing instruments comprises a transmitter unit configured to transmit said higher frequency part of said electrical signal. The other one of the hearing instruments comprises a receiver unit configured to receive said higher frequency part of said electrical signal. One of the signal processing units comprises a processing unit for processing said higher frequency part of said electrical signal with a processing filter prior to transmission or for processing said higher frequency part of said electrical signal after reception of said higher frequency part by the receiver unit with a processing filter. Furthermore one of the signal processing units is configured for generating a processed electrical signal from a combination of a lower frequency part and a higher frequency part of said electrical signal or a higher frequency part of the electrical signal processed with said processing filter.

The binaural hearing system can be operated in a way, that one of the hearing instruments on the side of a target sound source, i.e., the ipsilateral hearing instrument, generates a higher frequency part of the electrical signal generated from the received sound signal and transmits this higher frequency part to the other hearing instrument that is arranged on the side where mainly noise sources are located, i.e., the contralateral hearing instrument. The lower frequency parts of the respective electrical signals received by the input transducers of the respective hearing instruments, which contain interaural time difference cues, are then added to the higher frequency part of the electrical signal of the ipsilateral hearing instrument. The higher frequency part can furthermore be processed by a processing unit in order to simulate the head shadowing effect corresponding to the transmission of a sound signal from the ipsilateral side of the head to the contralateral side of the head before they are added to a respective lower frequency part. Operating the binaural hearing system in the above described way allows to improve the signal to noise ratio of the electrical signal while preserving the spatial cues.

As only the higher frequency part of the electrical signal is transmitted from one of the hearing instruments to the other hearing instrument a smaller bandwidth is required than for transmitting the full bandwidth electrical signal. Furthermore, spatial cues can be preserved as lower frequency parts of the hearing instruments can be used to generate a binaural electrical signal at each of the hearing instruments of the binaural hearing system.

The binaural hearing system can further comprise a hearing aid processing unit configured for applying hearing aid specific processing to the frequency parts and/or the electrical signals in order to generate a processed electrical signal. The hearing aid specific processing includes, but is not limited to frequency selective amplification, noise reduction, frequency transposition, user specific hearing improvement, environment dependent hearing improvement, or other hearing aid specific processing or combinations thereof.

The processing filter may resemble applying a head related transfer function in accordance with a hearing direction. The application of an interaural head related transfer function simulates the head shadowing effect, i.e., the transmission of a sound signal from the ipsilateral side of the head of the user to the contralateral side of the head of the user.

The processing unit for processing said higher frequency part of said electrical signal may comprise a low-pass filter and a time delay unit configured to delay an electrical signal in time. In this case the head shadowing effect is simulated by low-pass filtering and time delaying the higher frequency part of said electrical signal using the low-pass filter and the time delay unit. The cutoff frequency of the low-pass filter can for example be below 1200 Hz, such as below 900 Hz, such as below 800 Hz, preferably around 1 kHz. The time delay applied to the electrical signal by the time delay unit can for example have a value of 650 μs±50 μs. or around 600 μs±50 μs.

The signal processing unit of each of the hearing instruments may comprise a low-pass filter. The low-pass filters of the hearing instruments may have identical cutoff frequency.

The cutoff frequency of the lower frequency part may be below 1200 Hz, such as below 900 Hz, such as below 800 Hz.

The cutoff frequency of the higher frequency part may be above 500 Hz, such as above 600 Hz, such as above 800 Hz.

The frequency filters of said frequency filter unit for generating said lower frequency part and said higher frequency part may constitute a crossover filter having a crossover frequency of around 800 Hz. The crossover frequency can also be around 600 Hz, 700 Hz, 900 Hz or 1000 Hz.

The binaural hearing system may comprise a directionality unit. The directionality unit may then be configured for selecting a hearing direction relative to the hearing instrument. The directionality unit can be used to determine or select a hearing direction. The ipsilateral side and therefore the hearing instrument which is the ipsilateral hearing instrument can be determined in dependence of the hearing direction. The signal processing unit of the hearing instrument may be closer to the target sound source in the hearing direction, i.e., the ipsilateral hearing instrument is configured to provide said higher frequency part of said electrical signal for transmission to the respective other hearing instrument, i.e., the contralateral hearing instrument.

The binaural hearing system may comprise a user interface. The user interface may be configured to allow the user to select said hearing direction relative to the hearing instruments. The user interface can for example be implemented in one of the hearing instruments or in an external device. The hearing direction selected by the user interface can then be transmitted to the hearing instruments from the device comprising the user interface. The user interface can further be configured to control other functions of the binaural hearing system, e.g., overall sound volume, sensitivity of the system, user specific selections, or the like.

A signal processor of the binaural hearing system may be configured to introduce an interaural time delay between the two hearing instruments to compensate for the transmission delay introduced by sending the binaural signal between the two hearing instruments. The signal processor can for example be a time delay unit.

The binaural hearing system may comprise a beamformer configured to process said electrical signals. The beamformer can be applied on the electrical signals before they are filtered by the frequency filter unit and processed by the processing unit or after they have been filtered and processed. The beamformer can be implemented as a program or algorithm which can be executed on the signal processing unit of one of the hearing instruments.

The binaural hearing system may comprise at least one output transducer for generating an output perceivable as sound to the user based on said electrical signals. The output transducer can for example be a speaker, sometimes referred to as a receiver, a cochlear implant, a vibrator, or any other output transducer or combinations thereof.

Parts of the components or all components of the signal processing unit can be implemented in form of a program, an algorithm, programs or algorithms which can be executed on the signal processing unit in order to perform the respective task of the respective component as explained above.

The present disclosure further presents a method for generating an electrical signal using a binaural hearing system with a first hearing instrument and a second hearing instrument placed at respective first and second ear of a wearer. The method comprises a step of receiving a sound signal from the environment at each of the first and second hearing instruments. Furthermore the method comprises a step of generating a first electrical signal from the sound signal at the location of the first hearing instrument. The method further comprises a step of generating a second electrical signal from the sound signal at the location of the second hearing instrument. Furthermore the method comprises a step of generating a higher frequency part and a lower frequency part of one of the electrical signals by filtering. The method further comprises a step of generating a lower frequency part of the other electrical signal by filtering. Furthermore the method comprises a step of processing said higher frequency part with a filter, and transmitting said processed higher frequency part to the other hearing instrument or transmitting said higher frequency part to the other hearing instrument and processing said higher frequency part with a filter after transmission. The method further comprises a step of generating a processed electrical signal from a combination of a lower frequency part and a higher frequency part of said electrical signal or a processed higher frequency part processed with said filter.

The method may include the filter being used for processing said higher frequency part, which processing resembles applying a head related transfer function in accordance with a hearing direction.

Using the filter for processing said higher frequency part may comprise a step of filtering the higher frequency part with a low-pass filter and subsequently applying a time delay to the filtered higher frequency part. The low-pass filter can have a cutoff frequency of below 1200 Hz, such as below 900 Hz, such as below 800 Hz, such as around 1 kHz. The time delay applied to the higher frequency part of the electrical signal can for example have a value of 600 μs±50 μs, or 650 μs±50 μs.

The step of generating a higher frequency part and a lower frequency part of one of the electrical signals by filtering may be performed on the electrical signal of an ipsilateral side. The ipsilateral side can therefore be determined in a hearing direction selection step in which the hearing direction is selected. The selection of the hearing direction can be performed manually by the user or by an automatic method, e.g., based on interaural time delay measurements, sound pressure level measurements, voice activity measurements, or other suitable measurement methods known to the person skilled in the art in order to determine a direction of a sound or combinations thereof. Depending on the hearing direction one of the locations of the hearing instruments worn on the two ears of the user is chosen as the ipsilateral side and the other one as the contralateral side. The method then performs the step of generating a lower frequency part of the electrical signal by filtering on the contralateral side.

The method may further comprise a step of beamforming. In this case the beamforming may be either performed on the electrical signals as generated from the received sound signal or on the processed electrical signals.

The method may further comprise a step of generating a stimulus perceivable by a user as sound from the processed electrical signals.

The individual features of each aspect may be combined with any or all features of the other aspects. Likewise, the features mentioned in relation to the hearing system may be part of the method for operating the hearing system, and the features mentioned in relation to the method for operating the hearing system may be part of the hearing system.

The disclosure further presents use of a binaural hearing system to perform at least some of the steps of the method.

Figure 2:
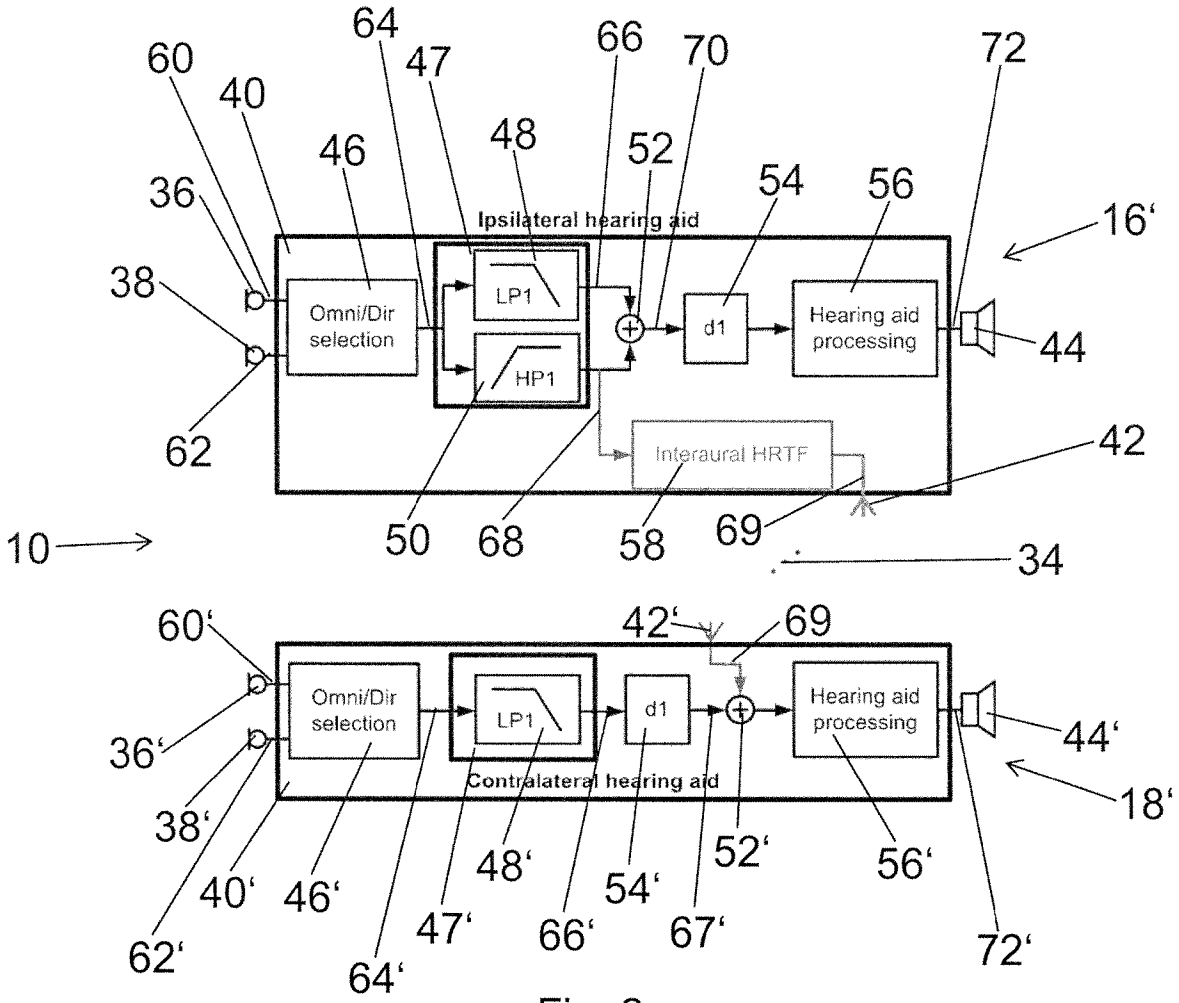
Figure 3:
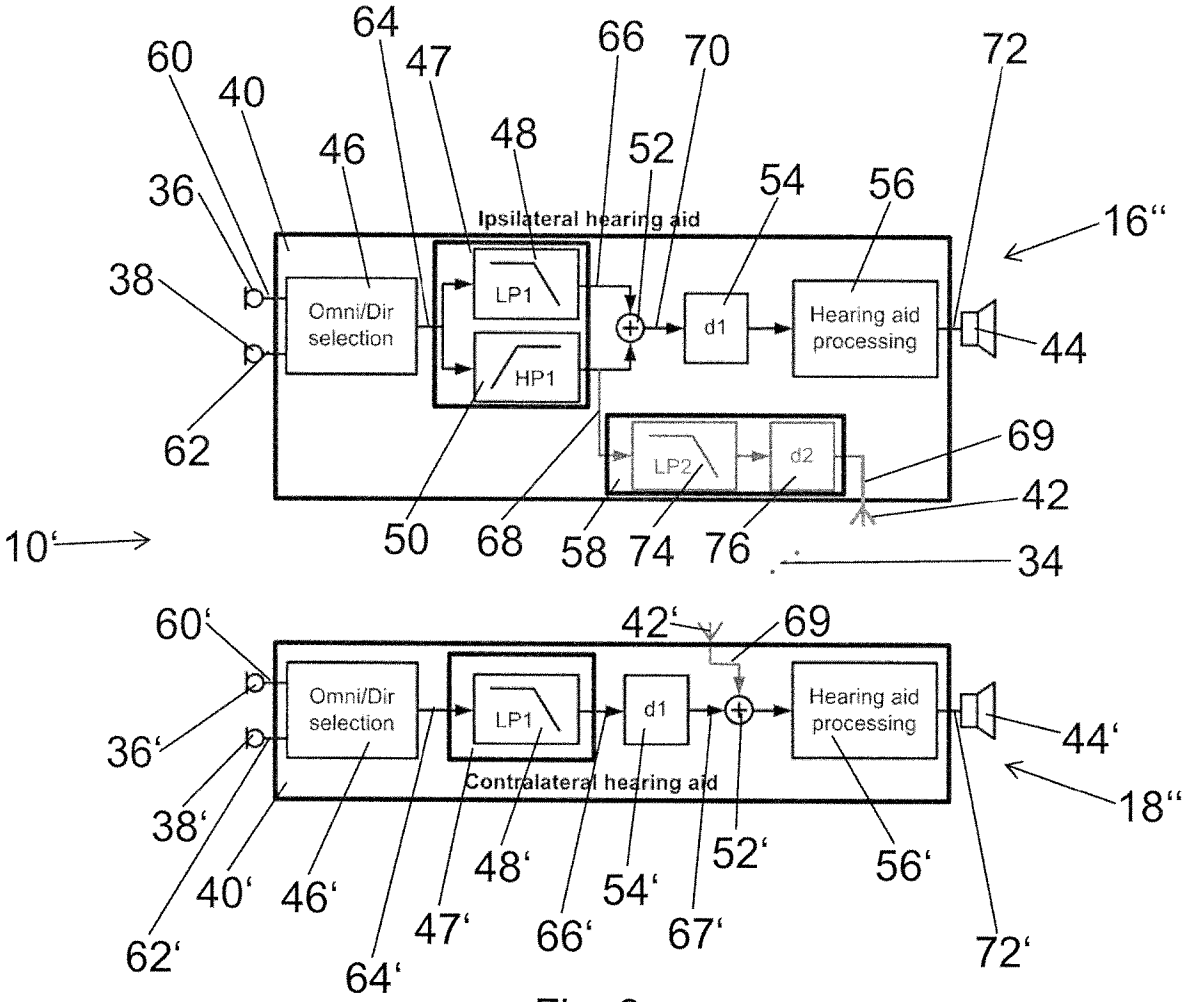
Figure 4:
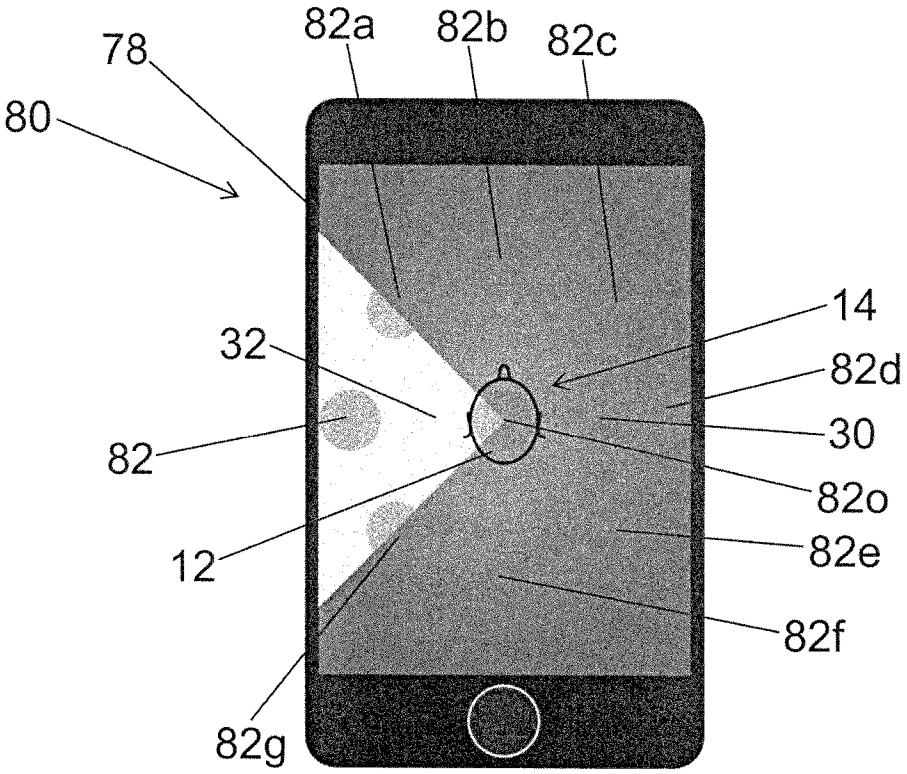
Figure 5:
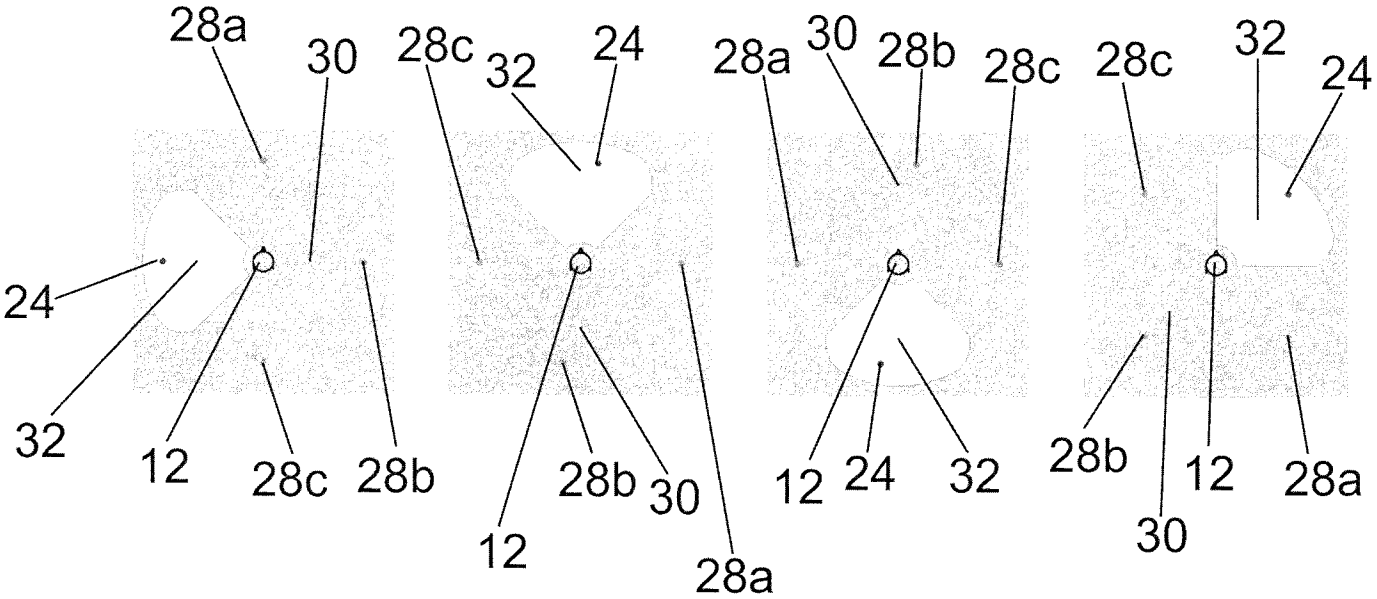
Figure 6:
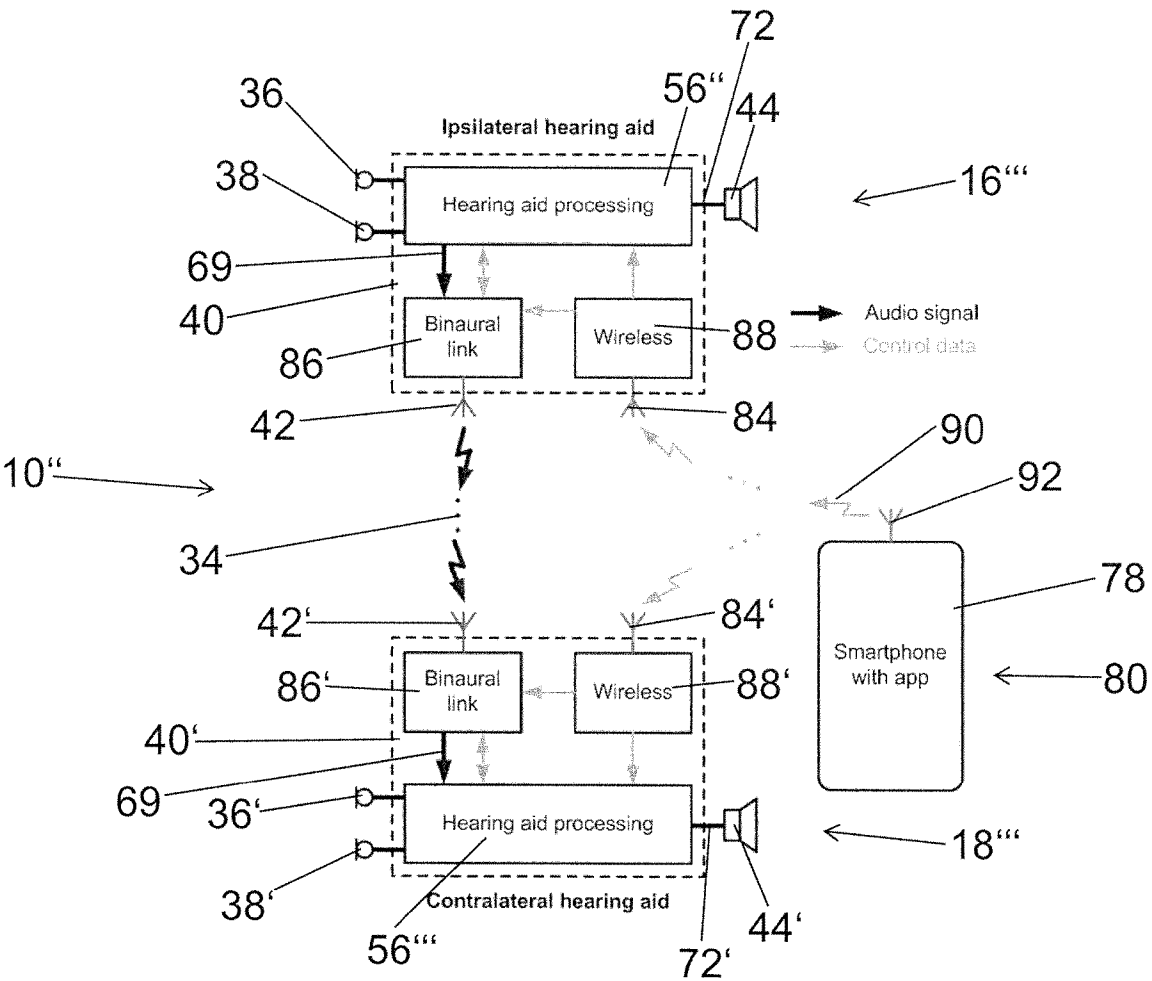

The present disclosure will further present the following detailed description of the accompanying figures, in which:

FIG. 1 schematically illustrates a binaural hearing system worn by a user listening to a target sound source;

FIG. 2 schematically illustrates a first binaural hearing system;

FIG. 3 schematically illustrates a second a binaural hearing system;

FIG. 4 schematically illustrates a user interface for selecting a hearing direction;

FIG. 5 schematically illustrates a binaural hearing system in four sound situation examples with different hearing directions;

FIG. 6 schematically illustrates a third binaural hearing system.

FIG. 1 shows a binaural hearing system 10 worn at the head 12 of a user 14. The binaural hearing system 10 comprises a first hearing instrument 16 and a second hearing instrument 18, which are worn at a left ear 20 and at a right ear 22, respectively, of the head 12 of user 14.

In FIG. 1 an exemplary sound situation is shown, in which a target sound source 24 provides sound 26, e.g., a person speaks, while noise sources 28*a*, 28*b*, 28*c*, 28*d*, and 28*e* provide noise. The binaural hearing system 10 is configured to divide the environment surrounding the user 14 into two subspaces around hearing direction 30 and noise direction 32. The subspace around noise direction 30 comprises the noise sources 28*a* to 28*e*. The subspace around hearing direction 32 comprises the target sound source 24 which provides sound 26 that user 14 wants to listen to. Sound received by the hearing instruments 16 and 18 of the binaural hearing system 10 from the subspace around the noise direction 30 is suppressed, while sound received from the subspace around the hearing direction 32 is amplified. In order to improve the signal to noise ratio of the received sound the hearing instrument 16 arranged on ipsilateral side of the head 12, i.e., the side in hearing direction 32 transmits a signal 34 to the hearing instrument 18 arranged on contralateral side of the head 12, i.e., the side opposite the hearing direction 32. Before transmitting the signal 34 processing may be performed in one of the hearing instruments 16 or 18 in order to simulate the head shadowing effect. This allows a natural-sounding directional filtering which suppresses unwanted sound on the opposite side, i.e. contralateral side of the head 12.

The processing is performed by creating a contralateral head-related transfer function (HRTF) for the hearing direction by applying an interaural head-related transfer function to the higher frequency part 68 of the signal. If the processing were performed for the full-bandwidth signal, it would create the impression that all sounds come from the direction of the ipsilateral ear. Thus, the processing is performed only on a higher frequency part of the signal 68, e.g., above 800 Hz while the lower frequency part of the signal, e.g., below 800 Hz is left unprocessed. By leaving the lower frequency part 66 of the signal unchanged the most important spatial cues, i.e., the interaural time differences, are kept unchanged, leaving all sound sources in their original position. At the same time, a large noise reduction is applied to the higher frequency part 68 of the signal.

FIG. 2 shows a binaural hearing system 10 with two hearing instruments 16' and 18'. The binaural hearing system 10 may be implemented in other ways, e.g., in which hearing instruments 16' and 18' are identical and perform identical operations. In alternatively (not illustrated) some of the tasks performed by hearing instrument 16' can also be performed by hearing instrument 18' and vice versa.

In FIG. 2 the hearing instruments 16' and 18' do not perform identical tasks. Hearing instrument 16' is arranged on the ipsilateral side of the head 12, e.g., hearing instrument 16 that is arranged at the side which is closer to the target sound source 24 in the sound situation shown in FIG. 1. Hearing instrument 18' is arranged on the contralateral side of the head 12, e.g., hearing instrument 18 that is arranged at the side comprising the majority of noise sources in the sound situation shown in FIG. 1. In case of an alternative sound situation, in which the target sound source 24 shown in FIG. 1 on the left side, is closer to the right side of the head 12 of user 14 the tasks performed by the hearing instruments 16 and 18 change in that the hearing instrument 18 arranged at the right ear 22 performs the tasks of hearing instrument 16' shown in FIG. 2, i.e., the ipsilateral hearing instrument 16' and the hearing instrument 16 arranged at the left ear 20 performs the tasks of hearing instrument 18' shown in FIG. 2, i.e., the contralateral hearing instrument 18'. Thus the operation of the hearing instruments 16 and 18 depends on the hearing direction 32, i.e., the direction of the target sound source 24 (see FIG. 1).

For the following, we assume that a binaural hearing system 10 with hearing instruments 16' and 18' is used in the exemplary sound situation of FIG. 1. Thus hearing instrument 16 corresponds to the ipsilateral hearing instrument 16' and hearing instrument 18 corresponds to contralateral hearing instrument 18'.

Hearing instrument 16' has two microphones 36 and 38, a signal processing unit 40, an antenna 42, and a speaker 44. The signal processing unit 40 of the hearing instrument 16' comprises a direction unit 46, a frequency filter unit 47 with low-pass filter 48 and with high-pass filter 50, a summation unit 52, a time delay unit 54, a hearing aid processing unit 56, and a processing unit 58.

Hearing instrument 18' has two microphones 36' and 38', a signal processing unit 40', an antenna 42', and a speaker 44'. The signal processing unit 40' of the hearing instrument 18' comprises a direction unit 46', a frequency filter unit 47' with low-pass filter 48', a time delay unit 54', a summation unit 52', and a hearing aid processing unit 56'.

In the following first the operation of ipsilateral hearing instrument 16' is explained followed by the operation of contralateral hearing instrument 18'. Both hearing instruments 16' and 18' receive the same sound 26 from the target sound source 24 and the same noise from the noise sources 28*a* to 28*e*, however, at different locations and separated by the head 12 of user 14 (see FIG. 1).

The microphones 36 and 38 of the ipsilateral hearing instrument 16' receive a sound signal from the environment comprising sound signal 26 and noise from the noise sources 28*a* to 28*e*. Each of the microphones 36 and 38 generates an electrical signal 60 and 62, respectively, from the received sound signal.

The electrical signals 60 and 62 are passed to the direction unit 46. The direction unit 46 processes the electrical signals 60 and 62 using a beamforming algorithm. Therefore the electrical signals 60 and 62 are first frequency selectively filtered, such that the beamforming is performed on predetermined frequency channels of the electrical signals 60 and 62. The beamforming can then be performed with a beamforming algorithm or beamforming method known to the person skilled in the art by the direction unit 46 for a certain hearing direction 32. Alternatively an omnidirectional hearing direction can be selected. In the case of an omnidirectional hearing direction the direction unit 46 passes the electrical signals 60 and 62, which means that no beamforming is performed on the electrical signals 60 and 62.

The direction unit 46 passes copies of the beamformed electrical signal 64 to frequency filter unit 47. The low-pass filter 48 and high-pass filter 50 are included in the frequency filter unit 47. Low-pass filter 48 filters the copy of the beamformed electrical signal 64 with a cutoff frequency of 800 Hz passing only lower frequency part 66 of the signal. The low-pass filter 48 can also be configured to filter the copy of the beamformed electrical signal 64 with a cutoff frequency below 1200 Hz, such as below 900 Hz, such as below 800 Hz. High-pass filter 50 filters the copy of the beamformed electrical signal 64 with a cutoff frequency of 800 Hz passing only higher frequency part 68 of the signal. The highpass filter 50 can also be configured to filter the copy of the beamformed electrical signal 64 with a cutoff frequency above 500 Hz, such as above 600 Hz, such as above 800 Hz. Here the low-pass filter 48 and the high-pass filter 50 constitute a crossover filter with a cross over frequency of 800 Hz. As indicated above, other crossover frequencies are obtainable.

A copy of the higher frequency part 68 of the signal is passed to the processing unit 58 which applies an interaural head related transfer function to the higher frequency part 68 of the signal. Other kind of filters may be applied by the processing unit 58 in order to simulate the head shadowing effect present between ipsilateral side and contralateral side of the head 12 of user 14. Processed higher frequency part 69 is passed to antenna 42 which transmits the processed higher frequency part 69 of the signal as signal 34 to the antenna 42' of contralateral hearing instrument 18' via a binaural audio link between the two antennae 42 and 42'.

Furthermore the lower frequency parts 66 and higher frequency parts 68 are passed to the summation unit 52 which adds both frequency parts of the signal in order to generate a filtered electrical signal 70.

The filtered electrical signal 70 is passed to the time delay unit 54 which adds a time delay to the filtered electrical signal 70 in order to compensate for the time delay that is introduced by the binaural audio link between hearing instrument 16' and hearing instrument 18'.

The time delayed filtered electrical signal is passed to the hearing aid processing unit 56, which processes the signal with hearing aid specific algorithms that can be user specific, sound environment dependent, e.g., depending on a general level of sound or other algorithms which allow to improve the electrical signal in order to improve hearing situation of user 14. The processing unit 56 generates a processed electrical signal 72 which can be provided to the speaker 44 in order to generate an output perceivable as sound to the user 14 wearing the hearing instrument 16' based on the processed electrical signal 72.

In the following the operation of hearing instrument 18' is explained. Some of the steps performed by hearing instrument 18' are similar to the steps performed by hearing instrument 16'. Hearing instrument 18', however, is on the contralateral side of the head 12 of user 14 and thus hearing instrument 18' receives sound with lower signal to noise ratio than hearing instrument 16', as more noise sources 28*a* to 28*d* are located on the contralateral side (see FIG. 1).

The microphones 36' and 38' of the contralateral hearing instrument 18' receive a sound signal from the environment comprising sound signal 26 and noise from the noise sources 28*a* to 28*e*. Each of the microphones 36' and 38' generates an electrical signal 60' and 62', respectively, from the received sound signal.

The electrical signals 60' and 62' are passed to the direction unit 46'. The direction unit 46' processes the electrical signals 60' and 62' using a beamforming algorithm. The beamforming of direction unit 46' is performed analogous to the beamforming of direction unit 46, i.e., signals are frequency filtered and a hearing direction 32 dependent beamforming or omnidirectional beamforming is applied.

The direction unit 46' passes the beamformed electrical signal 64' to frequency filter unit 47'. The low-pass filter 48' is included in the frequency filter unit 47' and filters the copy of the beamformed electrical signal 64' with a cutoff frequency of 800 Hz passing only lower frequency part 66' of the signal. The low-pass filter 48' can also be configured to filter the copy of the beamformed electrical signal 64' with a cutoff frequency below 1200 Hz, such as below 900 Hz, such as below 800 Hz. The low-pass filter 48' applied to beamformed electrical signal 64' is identical to the low-pass filter 48 applied to beamformed electrical signal 64 in the illustrated examples.

The lower frequency part 66' of the electrical signal is passed to the time delay unit 54' which adds a time delay to the lower frequency part 66' of the electrical signal in order to compensate for the time delay that is introduced by the binaural audio link between hearing instrument 16' and hearing instrument 18'.

Time delayed lower frequency part 67' is passed to the summation unit 52'. Furthermore processed higher frequency part 69 received by antenna 42' is passed to the summation unit 52'. The processed higher frequency part 69 comprises an inherent time delay due to the transmission from hearing instrument 16' to hearing instrument 18' which is compensated by the time delay added to lower frequency part 66' such that the processed higher frequency part 69 and time delayed lower frequency part 67' are in phase, i.e., the signals are aligned. The time delay applied to the lower frequency part 66' by time delay unit 54' has sample precision, in order to ensure alignment. Summation unit 52' adds both frequency parts in order to generate a time delayed filtered electrical signal. The time delayed filtered electrical signal comprises the lower frequency part 66' of the signal received from the contralateral side which mainly comprises spatial cues and the processed higher frequency part 69 of the signal received from the ipsilateral hearing instrument 16' which mainly comprises the sound signal 26 of target sound source 24 and which was further processed in order to simulate the head shadowing effect induced by head 12 of user 14. In this way, the signal to noise ratio can be significantly increased while spatial cues are preserved.

The time delayed filtered electrical signal is passed to the hearing aid processing unit 56' which processes the signal with hearing aid specific algorithms that can be user specific, sound environment dependent, e.g., depending on a general level of sound or other algorithms which allow to improve the electrical signal in order to improve hearing of user 14. The hearing aid processing unit 56' can perform the same operations on the time delayed filtered electrical signal as the hearing aid processing unit 56 of the ipsilateral hearing instrument 16'. The processing unit 56' generates a processed electrical signal 72' which can be provided to the speaker 44' in order to provide a sound signal to the user 14 wearing the hearing instrument 18'.

The implementation shown schematically in FIG. 2 performs the processing of the electrical signals generated by microphones 36, 36' 38, and 38' in the time domain. Alternatively, the electrical signals are processed in the frequency domain.

In FIG. 2 the local directionality processing, i.e., performed in directional unit 46 and 46', respectively, is performed as a first step. Alternatively, the binaural processing of the electrical signals can be performed first. The processing unit 58 can also be arranged in hearing instrument 18'. In this case the filters, particularly the interaural head related transfer function, applied by the processing unit 58 are applied in the contralateral hearing instrument 18'.

The ipsilateral and contralateral hearing instruments 16 and 18 (see FIG. 1) can both comprise all components of the ipsilateral hearing instrument 16', such that in dependence of the hearing direction 32 either the hearing instrument 16 can be the ipsilateral or the hearing instrument 18 can be the ipsilateral hearing instrument 16'. Thus the operation of the respective hearing instrument 16 and 18 depends on the hearing direction 32, i.e., the direction of the sound signal 26 generated by target sound source 24. The hearing instruments 16 and 18 can comprise a hearing direction selection unit in order to determine a hearing direction 32 or in order to select a hearing direction 32. The selection of a direction of sound as the hearing direction 32 can be based on signal to noise ratio of a direction of sound, overall sound pressure level of a direction of sound, voice activity detection in a direction of sound, a user selection of the direction of sound, any other method that can be used in order to determine a hearing direction or combinations, such as weighted combinations thereof.

The hearing instruments 16' and 18' can also comprise a binaural signal transmitter unit instead of speaker 44 and 44', respectively (not shown). In this configuration the binaural hearing system 10 is configured to provide a binaural electrical signal, which can be transmitted to an external device. For example the binaural hearing system 10 can be connected to an insertion part comprising a receiving unit and a speaker arranged in the ear canal of user 14. In this case the binaural electrical signal can be transmitted to the insertion part by the binaural signal transmitter unit in order to provide a sound signal to the user 14.

Parts of the components or all components of the signal processing unit 40 and 40', respectively, can be implemented in form of a program, an algorithm, programs or algorithms which can be executed on the signal processing unit 40 and 40', respectively, in order to perform the respective task of the respective component as explained above.

FIG. 3 illustrates a binaural hearing system 10' with two hearing instruments 16" and 18". The binaural hearing system 10' shown in FIG. 3 is similar to the binaural hearing system 10 shown in FIG. 2. In FIG. 3 the processing unit 58 comprises a processing lowpass filter 74 and a processing time delay unit 76.

The application of an interaural head related transfer function to the higher frequency part 68 is here implemented by the combination of low-pass filtering the higher frequency part 68 and time delaying it. This means the combination of the processing low-pass filter 74 and the processing time delay unit 76 is used to simulate the head shadowing effect, i.e., the effect on the sound signal which is caused by the transmission of the sound from the ipsilateral side of the head 12 to the contralateral side of the head 12 of user 14. Alternatively, the interaural head related transfer function can also be implemented in a FIR Filter (not shown).

The higher frequency part 68 is generated and passed to the processing unit 58 as described in FIG. 2. The processing low-pass filter 74 filters the higher frequency part 68 of the signal with a cutoff frequency of around 1 kHz and passes a low-pass filtered higher frequency part of the signal to the processing time delay unit 76. The processing low-pass filter 74 can also have a cutoff frequency of below 1200 Hz, such as below 900 Hz, such as below 800 Hz. Alternatively processing low-pass filter 74 can also be combined with high-pass filter 50 in one filter unit in order to apply both filters on the electrical signal 64 (not shown).

The processing time delay unit 76 adds a time delay with a value of 650 μs±50 μs to the low pass filtered higher frequency part generating a processed higher frequency part 69. Alternatively, a time delay with a value of 600 μs±50 μs may be added to the low pass filtered higher frequency part generating a processed higher frequency part 69. The time delay can also have a higher or lower value in dependence of the respective head 12 of user 14, but has the time delay with a value of 650 μs±50 μs for the sound situation shown in FIG. 1 when the binaural hearing system 10' is used.

The processed higher frequency part 69 is transmitted via antenna 42 to the contralateral hearing instrument 18" in which the processed higher frequency part 69 is added to the time delayed lower frequency part 67' and the resulting signal is processed by hearing aid processing unit 56' in order to generate a processed electrical signal 72'. The processed electrical signal 72' is passed to speaker 44' in order to provide a sound signal to the user 14 generated from the processed electrical signal 72'.

Thus, the processing in FIGS. 2 and 3 is minimal, as signals do not have to be sent both ways and the signal that is sent does not contain the full frequency bandwidth. Which hearing instrument 16 or 18 (see FIG. 1) is used to transmit and receive the processed higher frequency part 69 depends on the hearing direction 32, e.g., the direction of sound the user 14 wants to listen to or in which a target sound source 24 is located. In the sound situation shown in FIG. 1 the hearing instrument 16 on the left ear 20 corresponds to the ipsilateral hearing instrument 16" shown in FIG. 3 and the hearing instrument 18 on the right ear 22 corresponds to the contralateral hearing instrument 18" shown in FIG. 3.

In order to ensure proper functionality of the binaural hearing system 10' the hearing instruments 16" and 18" have to be aligned very precisely, i.e., with sample precision. The alignment with sample precision is also necessary to ensure proper functionality of hearing instruments 16' and 18' of the binaural hearing system 10 shown in FIG. 2.

FIG. 4 illustrates a user interface 78 implemented in an external device 80. The external device 80 can be connected to the binaural hearing system or it can be a component of the binaural hearing system. The connection can either be wire based or wireless (not shown). In FIG. 4 the connection is wireless. The external device 80 shown here is a smartphone. The external device 80 may be a mobile phone, a tablet pc, a laptop, or any suitable device.

The user interface 78 is used in order to determine a hearing direction 32. The determined hearing direction 32 is passed to the signal processing units 40 and 40' of the hearing instruments in order to allow the directional units 46 and 46' to perform beamforming in the hearing direction 32. Furthermore the hearing direction 32 is used to determine which one of the hearing instruments 16 and 18 is the ipsilateral hearing instrument and which one of them is the contralateral hearing instrument. Thus, the binaural directionality is combined with traditional front/back directionality in order to focus on a sound source around the user 14.

The user interface 78 illustrated in FIG. 4 comprises a touch display, which shows a selection of 8 directions of sound 82 to 82*g* and an omnidirectional direction of sound 82*o*. User 14 can select a hearing direction 32 by touching on one of the selection circles 82 to 82*o* corresponding to one direction of sound. The circles 82 to 82*g* each correspond to a 90°-subspace of a 360°-space corresponding to the sound environment around the head 12 of the user 14. The 90°-subspace has ±45°-subspaces around the hearing direction 32 defined by the respective circle 82 to 82*g*. The subspace can also be adjusted to e.g., 120°, 60°, or any other suitable subspace of the 360°-space around the head 12. Circle 82*o* corresponds to the 360°-space.

In FIG. 4 direction of sound 82 is selected by the user 14 as hearing direction 32. The directions of sound 82*a* to 82*o* that have not been selected as hearing direction 32 are considered as subspace of the noise direction 30. The subspace of the noise direction 30 corresponds to the remaining subspace not covered by the subspace of the hearing direction 32, i.e., here a 270°-subspace. If the user selects the circle 82*o* an omnidirectional listening mode is activated, i.e., no beamforming in any direction is selected. In the omnidirectional hearing direction case the selection of ipsilateral and contralateral hearing instrument can be based on interaural time delay measurements, sound pressure level measurements, voice activity measurements, or other suitable measurement methods known to the person skilled in the art in order to determine a direction of a sound or combinations thereof.

Alternatively, the user interface 78 may allow selecting more than one hearing direction 32, such that, e.g., a wider subspace of hearing direction can be selected by selecting two neighbouring directions of sound or changing the subspace size around the hearing direction 32. Also two opposite lying circles, e.g. 82 and 82*d* can be selected. The user interface 78 can also be implemented in any other way known to the skilled person, e.g., a keyboard combined with a non-touch sensitive display, a switch, or the like.

The user interface 78 can be a program, such as an app, executed or a method performed on an external device 80, e.g., a mobile phone, a smart phone, a tablet pc, a laptop, or any suitable device known to the person skilled in the art. The user interface 78 at all times allows the user 14 to identify the present hearing direction 32. The user 14 can thus decide to switch to another hearing direction 32 in order to improve hearing capability. Furthermore the user can also decide to turn off the manual selection of the hearing direction 32 using user interface 78 and activate an automatic method, e.g., based on interaural time delay measurements, sound pressure level measurements, voice activity measurements, or other suitable measurement methods known to the person skilled in the art in order to determine a direction of a sound or combinations thereof.

The external device 80 can also be implemented in one of the hearing instruments, e.g., in the form of a directionality unit (not shown). In this case the directionality unit determines the hearing direction 32. The determination of the hearing direction 32 by the directionality unit can be either through selection by the user 14 or by performing an automatic method, e.g., based on interaural time delay measurements, sound pressure level measurements, voice activity measurements, or other suitable measurement methods known to the person skilled in the art in order to determine a direction of a sound or combinations thereof.

FIG. 5 illustrates a binaural hearing system in four sound situation examples with different hearing directions 32. The hearing direction 32 is selected to be in the direction of target sound source 24 in all four shown examples. Noise sources 28*a* to 28*c* are located in the subspace of the noise direction 30. The hearing directions 32 in the four examples shown from left to right are left, front, back, front right relative to the head 12 of user 14. The hearing direction 32 has a focus beam that covers a 90°-subspace, i.e., the focus beam has a range of about 90° with ±45° around the hearing direction 32. The range can also be increased or decreased in dependence of the sound situation, e.g., if the user wants to listen to two target sound sources in a certain range.

FIG. 6 illustrates a binaural hearing system 10" comprising ipsilateral hearing instrument 16''', contralateral hearing instrument 18''' and external device 80.

The ipsilateral and contralateral hearing instruments 16''' and 18''' have identical components. Therefore only the components of the ipsilateral hearing instrument 16''' will be explained in the following and components of the hearing instrument 18''' corresponding to components of the ipsilateral hearing instrument 16''' are identified with identical reference signs with an added prime.

The hearing instrument 16''' comprises microphones 36 and 38, a signal processing unit 40, antenna 42, speaker 44, and a wireless antenna 84. The signal processing unit 40 comprises a hearing aid processing unit 56", a transceiver unit 86, and a wireless transceiver unit 88.

In the following the operation of the binaural hearing system 10" is explained.

The hearing aid processing unit 56" performs the operations of the hearing instrument 16''' in order to improve the hearing capability of user 14 wearing the hearing instrument 16''', i.e., the hearing aid processing unit 56" performs the operations performed by signal processing unit 40 of hearing instrument 16' shown in FIG. 2. Thus, the hearing aid processing unit 56" generates processed electrical signal 72 and the processed higher frequency part 69. The processed electrical signal 72 is passed to the speaker 44 in order to provide a sound signal to the user 14 wearing the hearing instrument 16'''. The processed higher frequency part 69 is passed to the transceiver unit 86 in order to generate a signal 34 which is transmitted via antenna 42 to antenna 42' of hearing instrument 18". Alternatively, the higher frequency part 68 is transmitted via signal 34 and the higher frequency part 68 is processed in hearing instrument 18''' (not shown).

Signal 34 is received by antenna 42' of hearing instrument 18''' and processed higher frequency part 69 contained in signal 34 is passed to hearing aid processing unit 56''' of hearing instrument 18". The hearing aid processing unit 56''' generates a processed electrical signal 72' which is passed to the speaker 44'. Speaker 44' generates a sound signal which is provided to the user 14.

The binaural hearing system 10" is controlled via user interface 78 of external device 80. The user interface 78 allows to select various modes of operation, e.g., user specific hearing improvement, environment dependent hearing improvement, beamforming, or the like and input parameters for the hearing instruments 16''' and 18''', e.g., hearing direction, user specific parameters, or the like. The external device 80 generates control data from the input to user interface 78 and transmits the control data in data signal 90 via external device antenna 92 to the wireless antennae 84 and 84' of the hearing instruments 16''' and 18'''.

The antennae 84 and 84' pass the data signal 90 to their respective wireless transceiver units 88 and 88', respectively, which generate control data from the data signal 90 and pass the control data to the other components of the respective hearing instrument 16''' and 18'''. Thus in hearing instrument 16''', wireless transceiver unit 88 passes control data to the transceiver unit 86 and to the hearing aid processing unit 56" and in hearing instrument 18''', wireless transceiver unit 88' passes control data to the transceiver unit 86' and to the hearing aid processing unit 56'''.

The control data is used by signal processing unit 40 and 40', respectively, to control the hearing aid processing and the transmission between the hearing instruments 16''' and 18''' of the binaural hearing system 10", e.g., beamforming, selection of ipsilateral and contralateral hearing instrument, and other processing performed by the binaural hearing system 10". The binaural link generated between the antennae 40, 40' and transceiver units 86, 86' is used to coordinate and synchronize the two hearing instruments 16' and 18'''. The binaural link can also be controlled via user interface 78 of external device 80.

The examples may be combined with other external devices, e.g., with a tablet pc or a smartphone. Furthermore, also an external device with a microphone and one or two instruments may be used to improve hearing capability of the user. In this case, the higher frequency part of the sound signal received by the microphone of the external device may be transmitted to one or both hearing instruments.

REFERENCE SIGNS

10 binaural hearing system
12 head
14 user
16 first hearing instrument
18 second hearing instrument
20 left ear
22 right ear
24 sound source
26 sound
28 noise source
30 noise direction
32 hearing direction
34 signal
36 first microphone
38 second microphone
40 signal processing unit
42 antenna
44 speaker
46 direction unit
47 frequency filter unit
48 low-pass filter
50 high-pass filter
52 summation unit
54 time delay unit
56 hearing aid processing unit
58 processing unit
60 electrical signal generated by the first microphone
62 electrical signal generated by the second microphone
64 beamformed electrical signal
66 lower frequency part
67 time delayed lower frequency part
68 higher frequency part
69 processed higher frequency part
70 filtered electrical signal

72 processed electrical signal
74 processing low-pass filter
76 processing time delay unit
78 user interface
80 external device
82 selection circle corresponding to direction of sound
84 wireless antenna
86 transceiver unit
88 wireless transceiver unit
90 data signal
92 external device antenna

The invention claimed is:

1. A hearing aid configured to be worn by a user at an ear, wherein said hearing aid comprises an input transducer for receiving a sound signal from the environment and for generating an electrical signal from the received sound signal, and a signal processing unit, wherein the signal processing unit comprises a processing unit for processing said electrical signal with a processing filter prior to transmission of said electrical signal to another hearing aid worn by the user at the other ear, wherein the hearing aid is configured to communicate with an external unit, the external unit comprising a user interface and wherein the user interface is configured to allow the user to select a hearing direction relative to the user's ears, and wherein the processing filter generates a processed higher frequency part of said electrical signal by applying a head related transfer function to a filtered higher frequency part of said electrical signal in accordance with said hearing direction selected by the user, the transfer function simulating a head shadowing effect corresponding to transmission of the sound signal from ipsilateral side of the head to the contralateral side of the head, the signal processing unit generating a processed electrical signal from a combination of a filtered lower frequency part of said electrical signal and one of: said filtered higher frequency part of said electrical signal and said processed higher frequency part generated by said processing filter, and the processing unit is configured to provide the processed electrical signal to the output transducer.

2. A binaural hearing system comprising two hearing instruments each configured to be worn by a user on either side of the head, wherein each of said hearing instruments comprises an input transducer for receiving a sound signal from the environment and for generating an electrical signal from the received sound signal, and a signal processing unit, wherein the signal processing unit of one of the hearing instruments comprises a processing unit for processing said electrical signal with a processing filter prior to transmission of said electrical signal to the other hearing instrument, wherein the binaural hearing system is configured to communicate with an external unit, the external unit comprising a user interface and wherein the user interface is configured to allow the user to select a hearing direction relative to the hearing instruments of the binaural hearing system, and wherein the processing filter generates a processed higher frequency part of said electrical signal by applying a head related transfer function to a filtered higher frequency part of said electrical signal in accordance with said hearing direction selected by the user, the transfer function simulating a head shadowing effect corresponding to transmission of the sound signal from ipsilateral side of the head to the contralateral side of the head, the signal processing unit generating a processed electrical signal from a combination of a filtered lower frequency part of said electrical signal and one of: said filtered higher frequency part of said electrical signal and said processed higher frequency part generated by said processing filter, and the processing unit is configured to provide the processed electrical signal to the output transducer.

3. The binaural hearing system according to claim 2, wherein the processing filter comprises a low-pass filter, and said processing unit further comprises a time delay unit configured to delay said electrical signal in time.

4. The binaural hearing system according to claim 2, wherein both of the hearing instruments include the signal processing unit, and the processing filters in the signal processing units of the respective hearing instruments comprise low-pass filters with an identical cutoff frequency.

5. The binaural hearing system according to claim 4, wherein the cutoff frequency of the processing low-pass filters is below 1100 Hz.

6. The binaural hearing system according to claim 2, wherein said signal processor is configured to introduce an interaural time delay between the two hearing instruments to compensate for the transmission delay introduced by sending the binaural signal between the two hearing instruments.

7. The binaural hearing system according to claim 2, further comprising a beamformer configured to process said electrical signals.

8. The binaural hearing system according to claim 2, wherein the binaural hearing system comprises at least one output transducer for generating an output perceivable as sound to the user based on said electrical signals.

9. A method for generating an electrical signal using a binaural hearing system with a first hearing instrument and a second hearing instrument placed at respective first and second ear of a wearer, the method comprising the steps receiving a sound signal from the environment at each of the first and second hearing instruments, generating a first electrical signal from the sound signal at the location of the first hearing instrument, generating a second electrical signal from the sound signal at the location of the second hearing instrument, processing said first electrical signal with a processing filter in said first hearing instrument, and transmitting said processed first electrical signal to said second hearing instrument, wherein the binaural hearing system communicates with an external unit, the external unit comprising a user interface configured to allow the user to select a hearing direction relative to the hearing instruments of the binaural hearing system, and wherein the processing filter generates a processed higher frequency part of said first electrical signal by applying a head related transfer function to a filtered higher frequency part of said first electrical signal in accordance with said hearing direction selected by the user, the transfer function simulating a head shadowing effect corresponding to transmission of the sound signal from ipsilateral side of the head to the contralateral side of the head, the signal processing unit generating a processed electrical signal from a combination of a filtered lower frequency part of said first electrical signal and one of: said filtered higher frequency part of said electrical signal and said processed higher frequency part generated by said processing filter, and the processed electrical signal is provided to the output transducer.

* * * * *